US005301386A

United States Patent [19]

Thomas et al.

[11] Patent Number: 5,301,386

[45] Date of Patent: Apr. 12, 1994

[54] APPARATUS FOR CLEANING FLAT SURFACES

[75] Inventors: Gilbert P. Thomas, Soliers; Jacky Y. L. Leguay, Plaine, both of France

[73] Assignee: Moulinex (Societe Anonyme), Bagnolet, France

[21] Appl. No.: 983,871

[22] Filed: Nov. 27, 1992

[30] Foreign Application Priority Data

Nov. 29, 1991 [FR] France ..... 91 14834

[51] Int. Cl.[5] ..... A47L 11/34

[52] U.S. Cl. ..... 15/321; 15/339; 15/353; 15/410

[58] Field of Search ..... 15/320, 321, 353, 410

[56] References Cited

U.S. PATENT DOCUMENTS

| | | | |
|---|---|---|---|
| 3,056,994 | 10/1962 | Noble | 15/321 |
| 3,552,100 | 1/1971 | Ekenberg | 15/353 X |
| 4,068,340 | 1/1978 | Forward | 15/321 |
| 4,216,563 | 8/1980 | Cyphert | 15/321 |
| 4,306,558 | 12/1981 | Kurtz et al. | 15/353 X |
| 4,724,573 | 2/1988 | Ostergaard | 15/321 |
| 4,910,828 | 3/1990 | Blase et al. | 15/353 X |
| 5,012,549 | 5/1991 | Williams et al. | 15/320 |
| 5,146,647 | 9/1992 | Blase et al. | 15/353 X |

FOREIGN PATENT DOCUMENTS

| | | |
|---|---|---|
| 0176697 | 4/1986 | European Pat. Off. . |
| 8515096.7 | 11/1986 | Fed. Rep. of Germany . |
| 2572920 | 5/1986 | France . |
| 7703126 | 9/1978 | Netherlands . |

*Primary Examiner*—Chris K. Moore

*Attorney, Agent, or Firm*—Young & Thompson

[57] ABSTRACT

Apparatus for cleaning flat surfaces comprising a collector (1) for dust and liquid connected to a suction moto-ventilator group (2) and to a suction (3). A reservoir (4) for cleaning liquid is connected to an injection pump group (5), itself connected to a nozzle (6) provided in the suction, as well as an electrical control (7) for the suction group. The injection group, said collector (1) and the reservoir (4) are mounted removably on the upper surface (8) of a base (9) which encloses the suction group (2) and injection group (5). The base (9) comprises an arch (21) which extends above the upper surface (8) of the base (9) in a transverse plane and which comprises two lateral members (23, 26) and a medial member (22) mounted articulately on one of the lateral members. The medial member (22) has at its free end (24) a locking member (25) with the other lateral member (26). A retainer immobilizes the collector and the reservoir on the base (9) when the medial member (22) is locked.

7 Claims, 2 Drawing Sheets

APPARATUS FOR CLEANING FLAT SURFACES

FIELD OF THE INVENTION

The invention relates to apparatus for cleaning flat surfaces such as for example floors or windows, comprising a dust and liquid collector connected, on the one hand, to a suction moto-ventilator group, and, on the other hand, to a suction, a cleaning liquid reservoir connected to an injection pump group, itself connected to a nozzle provided in said suction, as well as electrical control means for the suction and injection groups, said collector and said reservoir being mounted removably on the upper surface of a base which encloses said suction and injection groups.

BACKGROUND OF THE INVENTION

In known apparatus of this type, the problem arises of retaining the reservoir and collector on the base. Thus, this retention should be not only convenient and strong because the reservoir generally contains 8 liters of water and the apparatus is reciprocated, but also simple in structure thereby permitting keeping down the price of the apparatus.

SUMMARY OF THE INVENTION

The invention accordingly has for its object to overcome these problems in a simple and economical manner.

According to the invention, the base comprises an arch which extends above the upper surface of the base in a transverse plane, and which comprises two lateral members and a medial member mounted swingably on one of the lateral members and comprising on the one hand at its free end a locking member with the other lateral member and, on the other hand, retention means which can immobilize the collector and the reservoir on the base when the medial member is locked.

Thanks to this arrangement, it will be understood that by a simple pivoting of the medial member, the user can obtain either the simultaneous locking of the reservoir and the collector, or the unlocking of these latter for emptying the collector or replacing the reservoir. On the other hand, this arrangement is economical because it relies on a single locking element for retention of the collector and the reservoir.

According to another preferred characteristic, the medial member constitutes a carrying handle for the apparatus.

Thus, these constructional characteristics permit obtaining an easily portable apparatus, if need be, if there are stairs in a house. Moreover, this construction is economical and also imparts a desirable appearance by creating a compact apparatus.

BRIEF DESCRIPTION OF THE DRAWINGS

The characteristics and advantages of the invention will become more apparent from the description which follows, by way of example, with reference to the accompanying drawings, in which.

DETAILED DESCRIPTION OF THE INVENTION

Figure 1:
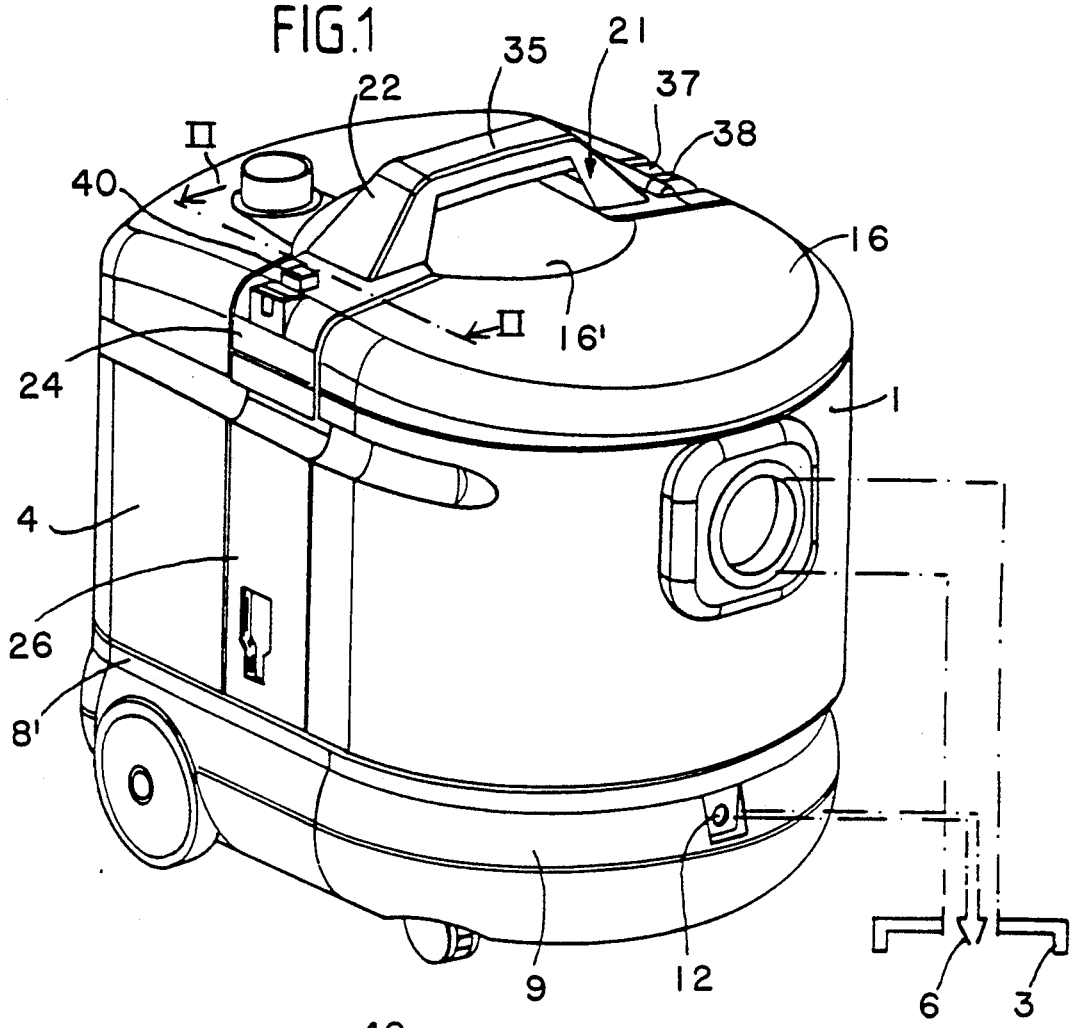
FIG. 1 is a perspective view of a cleaning apparatus according to the invention, and in which a liquid reservoir and a collector are maintained on a base by means of an arch.

The apparatus for cleaning flat surfaces such as for example floors or windows, comprises a collector 1 for dust and liquid connected on the one hand to a suction moto-ventilator group 2, and, on the other hand, to a suction 3 (shown schematically in FIG. 1), a reservoir 4 for cleaning fluid connected to an injection pump group 5 (shown in broken lines), itself connected to a nozzle 6 provided in said suction 3, as well as electrical control means 7 for said suction and injection groups, said collector and said reservoir 4 being mounted removably on the upper surface 8 of a base 9 which encloses said suction moto-ventilator group 2 and injection pump group 5. This upper surface 8 has a low peripheral flange 8,. The base 9 is supported by rollers 10 to permit displacement of the apparatus. As shown schematically, the injection pump group 5 is connected to the liquid reservoir 4 and to the connection of the nozzle 6 by means of automatic couplings 11 and 12 known per se.

Figure 2:
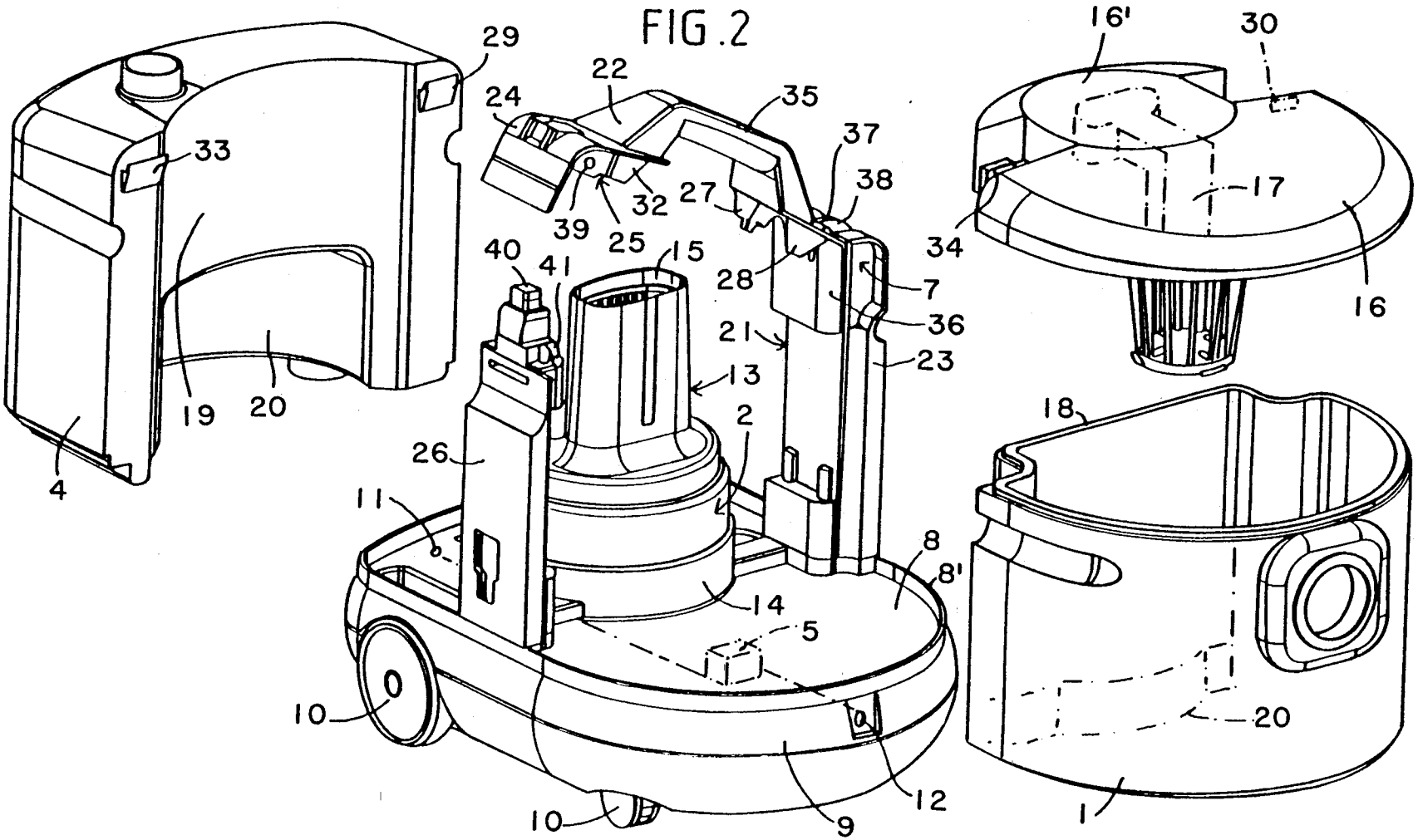
FIG. 2 is an exploded perspective view of the apparatus of FIG. 1.

Moreover, as is shown particularly in FIG. 2, the central region of the base 9 comprises a vertical sleeve 13 whose base 14 encloses the moto-ventilator group 2 and of which the upper end 15 is connected to a removable cover 16 of the collector 1 which comprises a suction conduit 17 opening into said collector.

So as to obtain a compact apparatus, the collector 1 and the reservoir 4 each have a generally semi-cylindrical shape, and their surfaces 18 and 19 turned toward each other each have a recess 20 adapted to enclose the base 14 of the chimney 13 so as to permit the juxtaposition of the collector 1 and the reservoir 4 on the base 9.

According to the invention, the base 9 comprises an arch 21 of inverted U shape, which extends above the upper surface 8 of said base in a transverse plane, and which comprises two lateral members 23, 26 and a medial member 22 mounted pivotally about a horizontal axis on one (23) of the lateral members and comprising on the one hand at its free end 24, a locking member 25 with the other lateral member 26 of the arch, and, on the other hand, retention means which immobilize the collector 1 and the reservoir 4 on the upper surface 8 of the base 9 when the medial member 22 is locked.

Figure 3:
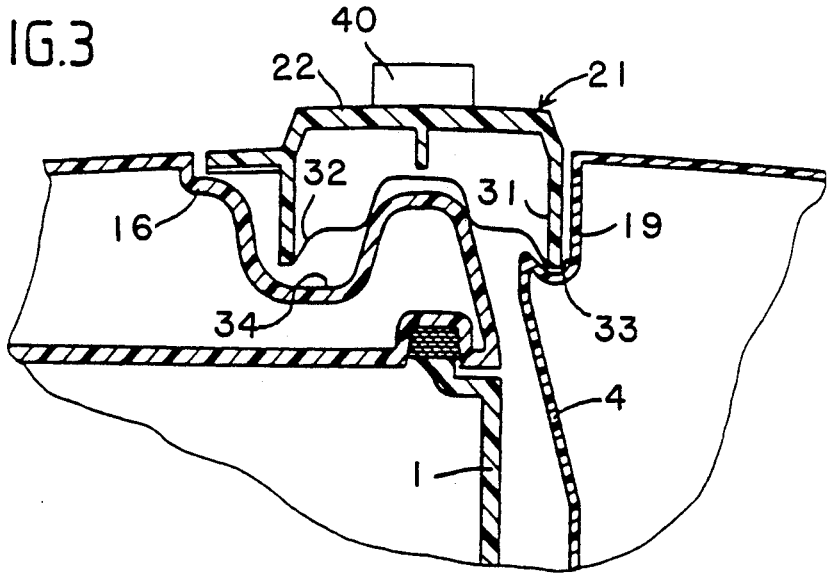
FIG. 3 is a fragmentary vertical cross section, on an enlarged scale, on the line III—III of FIG. 1, showing the locking of the reservoir and of the collector by the arch.

The reservoir 4 and the collector 1 being juxtaposed and provided on opposite sides of the transverse plane of the arch 21, the retention means comprise, on the medial member 22 of the arch, at least two spaced lateral tongues 27 and 28, adapted to come into engagement respectively with two recesses 29 and 30 respectively provided on the upper adjacent portions of the surfaces 18 and 19 of the collector and of the reservoir. Preferably, the tongues are four in number; the first set 27 and 28 is situated adjacent the articulation of the medial member 22, and the second set 31 and 32 (FIG. 3) is located adjacent the free end 24, said second set coming into engagement respectively with two other recesses 33 and 34 provided substantially diametrically to the recesses 29 and 30.

So as to permit mass production and low price, the base 9, the arch 21, the reservoir 4 and the collector provided with its cover 16 are of plastic material. Thus, as will be better seen in FIGS. 2 and 3, the upper portion of the collector 1 being constituted by the cover 16, this latter has in its upper surface 16' two depressions formed by molding opening laterally, in which are provided two recesses 30 and 34, and the upper portion of the reservoir 4, as two folds forming the two other recesses 29 and 33, while the medial member 22 has adjacent the recesses a transverse inverted U-shaped section whose lateral legs respectively bear the tongues 27, 28, 31 and 32.

According to another characteristic of the invention, the medial member 22 constitutes a handle for carrying the apparatus and is shaped for this purpose in its medial region into a bridge 35 spaced from the upper surface 16' of the cover 16.

So as to make easy the operation of the apparatus, the electric control means 7 are provided in the arch 21, and more particularly in the upper end 36 of one (23) of the members of the arch 21. These control means comprise switches (not shown) controlled by push buttons 37 and 38 for respectively controlling the suction group 2 and the injection group 5.

To explain the operation, let it be supposed that the apparatus is in the form disassembled as in FIG. 2, which is to say the reservoir 4 and the collector are removed from the base 9 and the medial member 22 is swung upwardly upon unlocking the locking member 25. This locking member 25 comprises for example in a manner known per se a catch 39 formed by a hole provided in the free end 24 of the medial member, while the lateral member 26 of the arch comprises an actuation button 40 of a retractable lug 41 adapted to engage in said catch 39.

As will be understood, the reservoir 4 being full of cleaning liquid, and the collector 1 being closed by its cover 16, these latter are juxtaposed on the base 9 and surround the vertical chimney 13. Then the medial member 22 is lowered until it engages the locking member 25–39 with the lug 41. In the course of this single movement, there is ensured the simultaneous securement of the reservoir 4 and the collector 1 on the base 9 by mutual engagement of the tongues 27, 28, 31 and 32 in the recesses 29, 30, 33 and 34. (See FIG. 3). Moreover, correct positioning of the cover 16 is ensured on the collector I, and therefore the seal of the collector and the good operation of the suction group.

Once this operation is concluded, the user can, without any risk of swinging the reservoir or collector, either carry the apparatus by means of the bridge 35 providing a handle, or roll it on the ground. Then, without bending over, the user can actuate as desired the push buttons 37 and/or 38 for controlling the suction group and the pump injection group for liquid toward the suction. The positioning of these buttons permits also avoiding the risk of electric shock in case of leakage from the liquid reservoir.

What is claimed is:

1. In an apparatus for cleaning flat surfaces comprising a collector for dust and liquid connected to a suction moto-ventilator unit and to a suction device, a reservoir for cleaning liquid connected to an injection pump unit, said injection pump unit being connected to a nozzle provided in said suction device, and electrical control means for said suction moto-ventilator unit and said injection pump unit, said collector and said reservoir being mounted removably on the base; the improvement wherein the base includes an arch which extends above and in a plane transverse to said base, said arch having two lateral members and a medial member mounted articulately on one of said lateral members and comprising at its free end a locking member adapted to lock with the other lateral member, and retention means for immobilizing the collector and the reservoir on the base when the medial member is locked.

2. Cleaning apparatus according to claim 1, wherein the reservoir and the collector are juxtaposed and disposed on opposite sides of the arch, said retention means comprising on the medial member of the arch at least two spaced lateral tongues adapted to come into engagement respectively with two recesses provided on upper adjacent portions of the reservoir and the collector.

3. Cleaning apparatus according to claim 2, wherein the upper portion of the collector is shaped as a cover and comprises one of said two recesses.

4. Cleaning apparatus according to claim 1, wherein the radial member constitutes a carrying handle for the apparatus.

5. Cleaning apparatus according to claim 1, wherein the electrical control means are provided in the arch.

6. Cleaning apparatus according to claim 5, wherein the electrical control means are provided in an upper end of one of the lateral members of the arch and comprise switches controlled by push buttons.

7. Cleaning apparatus according to claim 1, wherein a central region of the base includes a vertical sleeve which encloses the moto-ventilator unit, said sleeve having an upper end fluidly connected to the collector via a suction conduit opening into said collector.

* * * * *